US008643548B2

(12) United States Patent
Worl et al.

(10) Patent No.: US 8,643,548 B2
(45) **Date of Patent: *Feb. 4, 2014**

(54) DUAL BEAM DUAL SELECTABLE POLARIZATION ANTENNA

(75) Inventors: Robert Tilman Worl, Maple Valley, WA (US); Isaac Ron Bekker, Seattle, WA (US); Dan R. Miller, Puyallup, WA (US); Kenneth G. Voyce, Bellevue, WA (US); Ming Chen, Bellevue, WA (US); Harold J. Redd, Kent, WA (US)

(73) Assignee: The Boeing Company, Chicago, IL (US)

( * ) Notice: Subject to any disclaimer, the term of this patent is extended or adjusted under 35 U.S.C. 154(b) by 491 days.

This patent is subject to a terminal disclaimer.

(21) Appl. No.: 12/955,259

(22) Filed: Nov. 29, 2010

(65) Prior Publication Data

US 2011/0068993 A1 Mar. 24, 2011

Related U.S. Application Data

(62) Division of application No. 12/119,865, filed on May 13, 2008, now Pat. No. 7,868,830.

(51) Int. Cl.
*H01Q 1/38* (2006.01)

(52) U.S. Cl.
USPC ..... 343/700 MS; 343/872

(58) Field of Classification Search
USPC ..... 343/700 MS, 872
See application file for complete search history.

(56) References Cited

U.S. PATENT DOCUMENTS 2,925,722 A * 2/1960 Blackburn et al. ..... 62/175
4,489,999 A 12/1984 Miniet
4,554,505 A 11/1985 Zachry
5,019,829 A 5/1991 Heckman et al.
5,163,837 A 11/1992 Rowlette, Sr.
5,219,137 A 6/1993 Stepanek et al.
5,276,455 A 1/1994 Fitzsimmons et al.
5,468,996 A 11/1995 Chan et al.
5,745,346 A 4/1998 Ogawa et al.
5,777,855 A 7/1998 Yokajty (Continued)

FOREIGN PATENT DOCUMENTS

JP 62105501 A 5/1987
WO 9723923 A 7/1997

OTHER PUBLICATIONS

U.S. Appl. No. 12/703,477, filed Feb. 10, 2010, Heisen et al.

(Continued)

*Primary Examiner* — Douglas W Owens
*Assistant Examiner* — Jae Kim
(74) *Attorney, Agent, or Firm* — Yee & Associates, P.C.

(57) ABSTRACT

A dual beam dual-selectable-polarization phased array antenna comprises an aperture unit, a printed wiring board, radiating elements, chip units, a pressure plate, and a rear housing unit. The printed wiring board has sub assemblies bonded to each other with a bonding material providing both mechanical and electrical connection. The printed wiring board is connected to the aperture unit. The radiating elements are formed on the printed wiring board. The chip units are mounted on the printed wiring board. The chip units include circuits capable of controlling radio frequency signals radiated by the radiating elements to form dual beams with independently selectable polarization. The pressure plate is connected to the aperture unit. The aperture unit is connected to the rear housing unit such that the aperture unit covers the rear housing unit.

15 Claims, 8 Drawing Sheets

(56) References Cited

U.S. PATENT DOCUMENTS

| | | | | |
|---|---|---|---|---|
| 5,886,671 | A * | 3/1999 | Riemer et al. | 343/776 |
| 5,917,709 | A | 6/1999 | Johnson et al. | |
| 6,020,848 | A | 2/2000 | Wallace et al. | |
| 6,271,728 | B1 | 8/2001 | Wallace et al. | |
| 6,424,313 | B1 | 7/2002 | Navarro et al. | |
| 6,469,671 | B1 | 10/2002 | Pluymers et al. | |
| 6,469,909 | B2 | 10/2002 | Simmons | |
| 6,670,930 | B2 | 12/2003 | Navarro | |
| 6,768,471 | B2 | 7/2004 | Bostwick et al. | |
| 6,900,765 | B2 | 5/2005 | Navarro et al. | |
| 6,989,791 | B2 | 1/2006 | Navarro et al. | |
| 7,093,987 | B2 | 8/2006 | Brezina et al. | |
| 7,187,342 | B2 | 3/2007 | Heisen et al. | |
| 7,307,586 | B2 | 12/2007 | Peshlov et al. | |
| 7,342,801 | B2 | 3/2008 | Jandzio et al. | |
| 7,388,756 | B1 | 6/2008 | Worl et al. | |
| 7,436,679 | B2 | 10/2008 | Iijima et al. | |
| 7,446,261 | B2 | 11/2008 | Kumar et al. | |
| 7,515,013 | B2 | 4/2009 | O'Connell et al. | |
| 7,580,003 | B1 | 8/2009 | Davis et al. | |
| 7,629,538 | B2 | 12/2009 | Heisen et al. | |
| 7,690,107 | B2 | 4/2010 | Heisen et al. | |
| 7,782,268 | B2 | 8/2010 | Carroll et al. | |
| 7,868,830 | B2 | 1/2011 | Worl et al. | |
| 7,884,768 | B2 | 2/2011 | Navarro et al. | |
| 7,889,135 | B2 | 2/2011 | Blaser et al. | |
| 2002/0089835 | A1 | 7/2002 | Simmons | |
| 2003/0002265 | A1 | 1/2003 | Simmons | |
| 2003/0103739 | A1 | 6/2003 | Brezina et al. | |
| 2005/0017904 | A1 | 1/2005 | Navarro et al. | |
| 2005/0219137 | A1 | 10/2005 | Heisen et al. | |
| 2005/0243527 | A1 * | 11/2005 | Jandzio et al. | 361/760 |
| 2006/0109366 | A1 | 5/2006 | Humpston et al. | |
| 2006/0152414 | A1 | 7/2006 | Peshlov et al. | |
| 2006/0202312 | A1 | 9/2006 | Lijima et al. | |
| 2007/0001919 | A1 | 1/2007 | Carroll et al. | |
| 2008/0106484 | A1 | 5/2008 | Navarro et al. | |
| 2008/0110020 | A1 | 5/2008 | Heisen et al. | |
| 2008/0310125 | A1 | 12/2008 | Heisen et al. | |
| 2008/0316139 | A1 * | 12/2008 | Blaser et al. | 343/872 |
| 2009/0284415 | A1 | 11/2009 | Worl et al. | |
| 2011/0024161 | A1 | 2/2011 | Heisen et al. | |

OTHER PUBLICATIONS

USPTO *Ex Parte* Office Action regarding U.S. Appl. No. 11/763,879, dated Aug. 7, 2009, 7 pages.

USPTO Notice of Allowance regarding U.S. Appl. No. 11/765,332, dated Sep. 1, 2010, 4 pages.

USPTO notice of allowance dated Jun. 15, 2012 regarding U.S. Appl. No. 12/703,477, 7 Pages.

USPTO non-final office action dated Feb. 17, 2012 regarding U.S. Appl. No. 12/703,477, 15 Pages.

Office Action issued on Apr. 15, 2011 for U.S. Appl. No. 12/703,477.

Final Office Action issued on Oct. 7, 2011 for U.S. Appl. No. 12/703,477.

Office Action issued on Mar. 6, 2009 for U.S. Appl. No. 11/763,879.

Notice of Allowance issued on Nov. 25, 2009 for U.S. Appl. No. 11/763,879.

Office Action issued on Apr. 2, 2010 for U.S. Appl. No. 11/765,332.

Notice of Allowance issued on Oct. 29, 2010 for U.S. Appl. No. 11/765,332.

Notice of Allowance issued on Oct. 19, 2010 for U.S. Appl. No. 12/119,865.

McIlvenna et al., "EHF Monolithic Phased Arrays—a Stepping-Stone to the Future", pp. 731-735, IEEE, Oct. 23, 1988.

Maillous, "Antenna Array Architecture", IEEE, New York, US, vol. 80, No. 1, Jan. 1992, pp. 163-172.

* cited by examiner

DUAL BEAM DUAL SELECTABLE POLARIZATION ANTENNA

CROSS-REFERENCED TO RELATED APPLICATION

This application is a divisional of application Ser. No. 12/119,865, filed on May 13, 2008, status allowed.

GOVERNMENT LICENSE RIGHTS

This invention was made with Government support under prime contract number F19628-00-C-0002 between MIT/Lincoln Labs and the Government. The Boeing Company is the subcontractor for this invention under contract number 3039171. The Government has certain rights to this invention.

BACKGROUND INFORMATION

1. Field

The present disclosure is directed towards antennas and in particular to phased array antennas. Still more particularly, the present disclosure relates to a phased array antenna having a tile architecture.

2. Background

A phased array antenna is a group of antennas in which the relative phases of the respective signals feeding the antennas may be varied in a way that the effect of radiation pattern of the array is reinforced in a desired direction and suppressed in undesired directions. In other words, one or more beams may be generated that may be pointed in or steered into different directions. A beam pointing in a transmit or receive phased array antenna is achieved by controlling the phasing timing of the transmitted or received signal from each antenna element in the array.

The individual radiated signals are combined to form the constructive and destructive interference patterns of the array. A phased array antenna may be used to point one or more fixed beams or to scan one or more beams rapidly in azimuth or elevation.

With phased array antenna systems, the size and complexity of an antenna may be a concern depending on the use. In some uses, the amount of room for the different components in a phased array antenna may be limited. As a result, some phased array antenna designs may be too large to fit within the space that may be allocated for a phased array antenna.

Therefore, it would be advantageous to have a method and apparatus for overcoming the problems described above.

SUMMARY

In one advantageous embodiment, a dual beam dual-selectable-polarization phased array antenna comprises an aperture unit, a multilayer printed wiring board, a plurality of radio frequency radiating elements, a plurality of chip units, a pressure plate, and a rear housing unit. The multilayer printed wiring board has a plurality of sub assemblies bonded to each other with a bonding material providing both mechanical and electrical connection, wherein the multilayer printed wiring board is connected to the aperture unit. The plurality of radio frequency radiating elements is formed on the multilayer printed wiring board. The plurality of chip units is mounted on the multilayer printed wiring board and wherein the plurality of chip units includes circuits capable of controlling radio frequency signals radiated by the plurality of radio frequency radiating elements to form dual beams with selectable polarization. The pressure plate is connected to the aperture unit. The aperture unit is connected to the rear housing unit such that the aperture unit covers the rear housing unit.

In another advantageous embodiment, an apparatus comprises a printed wiring board having a plurality of sub assemblies bonded to each other with a bonding material providing both a mechanical and an electrical connection; a plurality of radio frequency radiating elements formed on a first side of the printed wiring assembly; a plurality of chips units mounted on a second side of the printed wiring assembly, wherein the plurality of chip units are capable of controlling radio frequency signals radiated by the plurality of radio frequency radiating elements to form dual beams with selectable polarization; and a housing unit, wherein the printed wiring board, the plurality of radio frequency radiating elements, and the plurality of chip units are located inside the housing unit.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
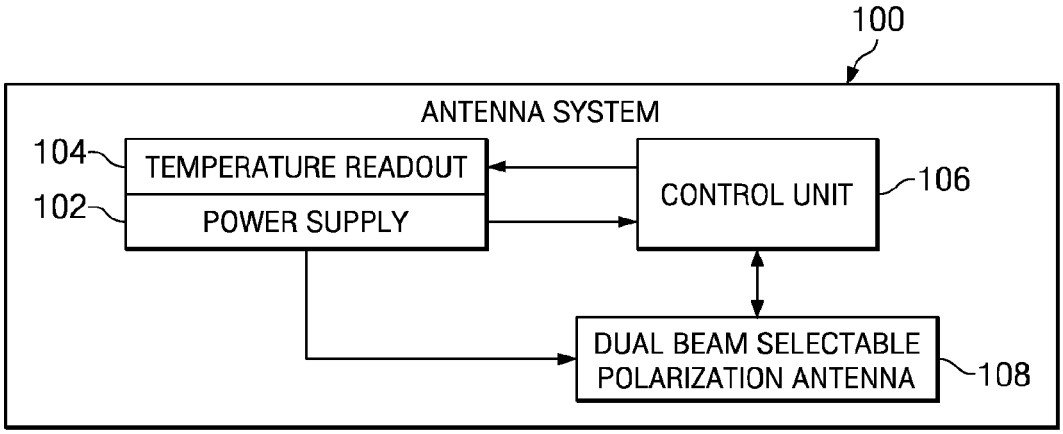
FIG. 1 is a diagram illustrating a configuration of an antenna system in which an advantageous embodiment may be implemented.

With reference now to the figures and in particular with reference now to FIG. 1, a diagram illustrating a configuration of an antenna system is depicted in accordance with an advantageous embodiment. In this example, antenna system 100 comprises power supply 102, temperature readout 104, control unit 106, and dual beam selectable polarization antenna 108. In these examples, power supply 102 provides power to control unit 106 and dual beam selectable polarization antenna 108.

Control unit 106 controls the array pointing angle and polarization for each of the beams that may be generated by dual beam selectable polarization antenna 108. In other words, dual beam selectable polarization antenna 108 may generate two beams of directive radiation. Each of these beams may be pointed in different directions and may have a different polarization.

For example, one beam may have a right-hand circular polarization and may be directed at an angle around 60, and 90 (theta, phi) degrees with the z axis being orthogonal to the x-y plane created by the plane of the antenna array aperture. The other beam may have a left-hand circular polarization and may be directed at an angle around 60, and 270 (theta, phi) degrees. In other advantageous embodiments, both beams may have the same type of circular polarization.

Control unit 106 also takes data from dual beam selectable polarization antenna 108 and sends that data to temperature readout 104 for presentation to an operator and for automated power-down features.

In the different advantageous embodiments, dual beam selectable polarization antenna 108 employs a tile architecture instead of a brick architecture. Further, dual beam selectable polarization antenna 108 also employs phased arrays that may be used at a K-band and employs a chip-on-board configuration. Dual beam selectable polarization antenna 108 may operate around 20 GHz in these examples. This antenna may be operated to produce one or two independently controllable receive beams in these examples.

Figure 2:
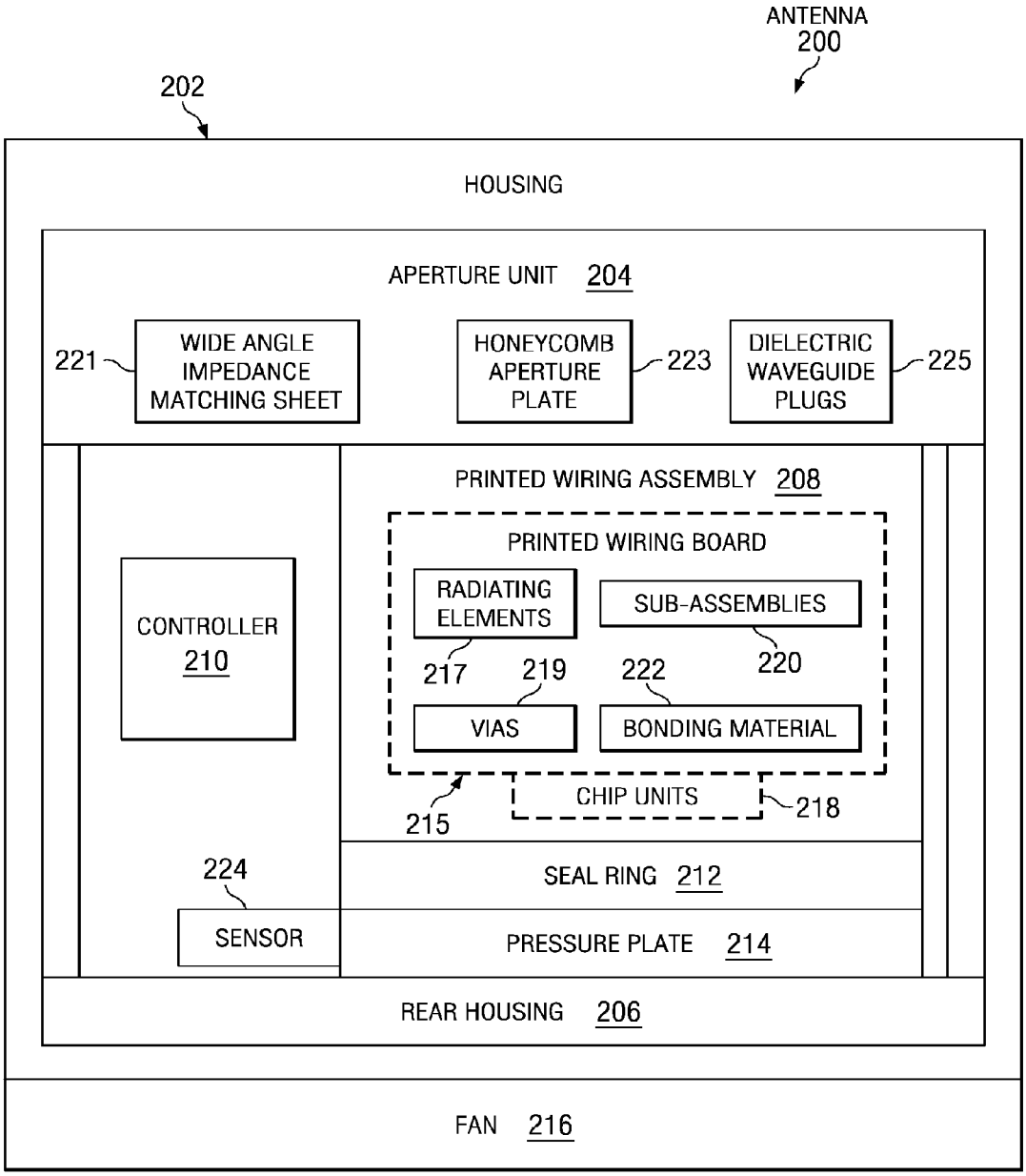
FIG. 2 is a diagram of an antenna in accordance with an advantageous embodiment.

With reference now to FIG. 2, a diagram of an antenna is depicted in accordance with an advantageous embodiment. Antenna 200 is an example of a dual beam dual selectable polarization phased array antenna. Antenna 200 is an example of an antenna that may be used to implement dual beam selectable polarization antenna 108 in FIG. 1. In these examples, antenna 200 includes housing 202. Housing 202 is formed from aperture unit 204 and rear housing 206 in these examples. Antenna 200 also includes printed wiring assembly 208, controller 210, seal ring 212, and pressure plate 214. Additionally, antenna 200 also may include fan 216.

In these examples, aperture unit 204 may include wide angle impedance matching sheet 221, honey comb aperture plate 223, and dielectric waveguide plugs 225. Honeycomb aperture plate 223 in aperture unit 204 may include multiple channels in which each channel is a waveguide for a corresponding radiating element within printed wiring assembly 208. These channels form waveguides for the elements in the phased array.

Dielectric waveguide plugs 225 fill the waveguides to achieve the desired cutoff frequency for antenna 200. Additionally, aperture unit 204 also serves as part of housing 202. In these examples, aperture unit 204 functions as a lid or top section for housing 202. Aperture unit 204 also contains the wide angle impedance matching stackup.

In these examples, printed wiring assembly 208 includes printed wiring board 215 and chip units 218. Radiating elements 217 and vias 219 are formed in printed wiring board 219. Radiating elements 217 may send and/or receive radio frequency signals.

In these examples, the radio frequency signals may be microwave radio frequency signals. Chip units 218 may be formed on or mounted to printed wiring board 217. Chip units 218 are sets of chips. In other words, each chip unit is a set of chips. A set as used herein refers to one or more elements. In these examples, chips take the form of integrated circuits which may be formed on a material, such as semi-conductor material. These chips may be packaged or unpackaged depending on the particular implementation.

Examples of chips that may be in chip units 218 include, for example, application specific integrated circuits, passive components, a molybdenum tab heat spreader, and monolithic microwave integrated circuits, and other suitable components. In the different advantageous embodiments, radiating elements 217 are located on an opposite side of printed wiring board 217 from chip units 218.

In the different advantageous embodiments, a chip unit within chip units 218 corresponds to a radiating element within radiating elements 217. In other words, a chip unit is electrically connected to a radiating element. Each corresponding chip unit may be located on an opposite side of printed wiring assembly 208 from the corresponding radiating element.

In these depicted examples, a radiating element and a chip are electrically connected to each other through a via in vias 219. Chip units 218 may be mounted in a manner that does not require a 90 degree bend in the pathways connecting chip units 218 to radiating elements 217. In other words, the spacing and/or arrangement of radiating elements 217 avoids 90 degree transitions between a sub assembly containing antenna elements and a sub assembly containing chip units 218 and/or electronics in antenna 200.

Further, chip units 218 may be packaged in a column of parallel layers within printed wiring assembly 208. These layers may be the different sub assemblies that are connected and/or attached to each other for printed wiring board 215.

The 90 degree bend is between the contact pad surfaces for the via and the chip in these examples. One feature in this type of architecture lies in the transition from the output of the chip carrier to the input of the radiator or antenna integrated printed wiring board (AIWPB). Losses in this area are directly proportional to reduced radiated power on transmit and noise figure on receive. Previous designs have relied on the use of wirebonds and epoxy to make the electrical and mechanical connection between these last two components. A good connection here (both electrically and mechanically robust) increases the overall performance of the array and any variance can degrade said performance.

Chip units 218 may include, for example, power amplifier circuits, driver amplifier circuits, phase shifter circuits, and other suitable circuits for use in generating and altering radio frequency signals. In these examples, chip units 218 amplify and control the emission of microwave radio frequency signals in a manner to generate the dual beams with the desired polarization.

Printed wiring board 215 is a structure that provides mechanical support and electrical connections for different components. Electrical connection may be provided between radiating elements 217 and chip units 218. Further, printed wiring board 215 may provide these interconnections using conductor pathways or traces. These pathways or traces may be etched from copper sheets laminated onto a non-conductive substrate.

In these different advantageous embodiments, printed wiring board 215 is formed from sub-assemblies. In these examples, printed wiring board 215 may include, for example, three sub-assemblies within sub-assemblies 220. These sub-assemblies may include a sub-assembly for radiating elements, a sub-assembly for distributing radio frequency signals, and a sub-assembly for power and digital signal distribution.

Of course, depending on the particular implementation, other numbers and types of sub-assemblies may be used in place and in addition to these examples. Each sub-assembly in the different sub-assemblies 220 may each be a printed wiring board that is bonded or attached to another printed wiring board within sub-assemblies 220. In these examples, sub-assemblies 220 are bonded to each other using bonding material 222. Bonding material 222 is selected as material that provides both mechanical bonding and electrical properties.

Examples of chips that may be in chip units 218 include, for example, application specific integrated circuits, passive components, a molybdenum tab heat spreader, and monolithic microwave integrated circuits, and other suitable components. The connection of sub-assemblies may be performed through a non-conductive adhesive pre-form material that is cut to form areas where conductive bonding material 222 may be placed to form an electrical connection between the different sub-assemblies.

Radiating elements 217 are the elements that radiate radio frequency energy to produce beams for antenna 200. Each radiating element within radiating elements 217 radiates radio frequency energy in response to radio frequency signals amplified by chip units 218. The collective emission of radio frequency energy by radiating elements 217 may generate one or two beams that may be directed or steered.

In these examples, printed wiring assembly 208 is mounted on aperture unit 204 and secure by pressure plate 214. In these examples, pressure plate 214 may be mounted on aperture unit 204. Rear housing 206 may then be mounted on aperture unit 204 while providing contact to pressure plate 214.

Further, pressure plate 214 also may act as a primary heat sink for heat generating components within printed wiring assembly 208. In these examples, the heat generating components may be, for example, chip units 218. Seal ring 212 provides a seal and/or connection between printed wiring assembly 208 and pressure plate 214. Further, seal ring 212 also may be part of a heat path for chip units 218 to pressure plate 214 in cooling those components. Sensor 224 may be mounted on pressure plate 214 to provide temperature data to report the temperature of pressure plate 214.

Controller 210 performs electronic beam steering. Controller 210 may control the array pointing angle and polarization for each beam generated by radiating elements 217. In these examples, chip units 218 may be controlled to generate two beams with different polarizations. In these examples, controller 210 provides this control through signals sent to chip units 218. Controller 210 may receive control signals from control unit 106 in FIG. 1.

Fan 216 in these examples is located on the outside of housing 202. In particular, fan 216 may be mounted to rear housing 206 to provide further cooling. The illustration of antenna 200 in FIG. 2 is not meant to provide architectural limitations to the manner in which antenna 200 may be implemented. For example, antenna 200 may have other components in addition to or in place of the ones depicted in FIG. 2. Further, the depiction of antenna 200 in FIG. 2 is in a block diagram form to illustrate different components. This illustration is not intended as an illustration of layouts or geometries for the different components.

Figure 3:
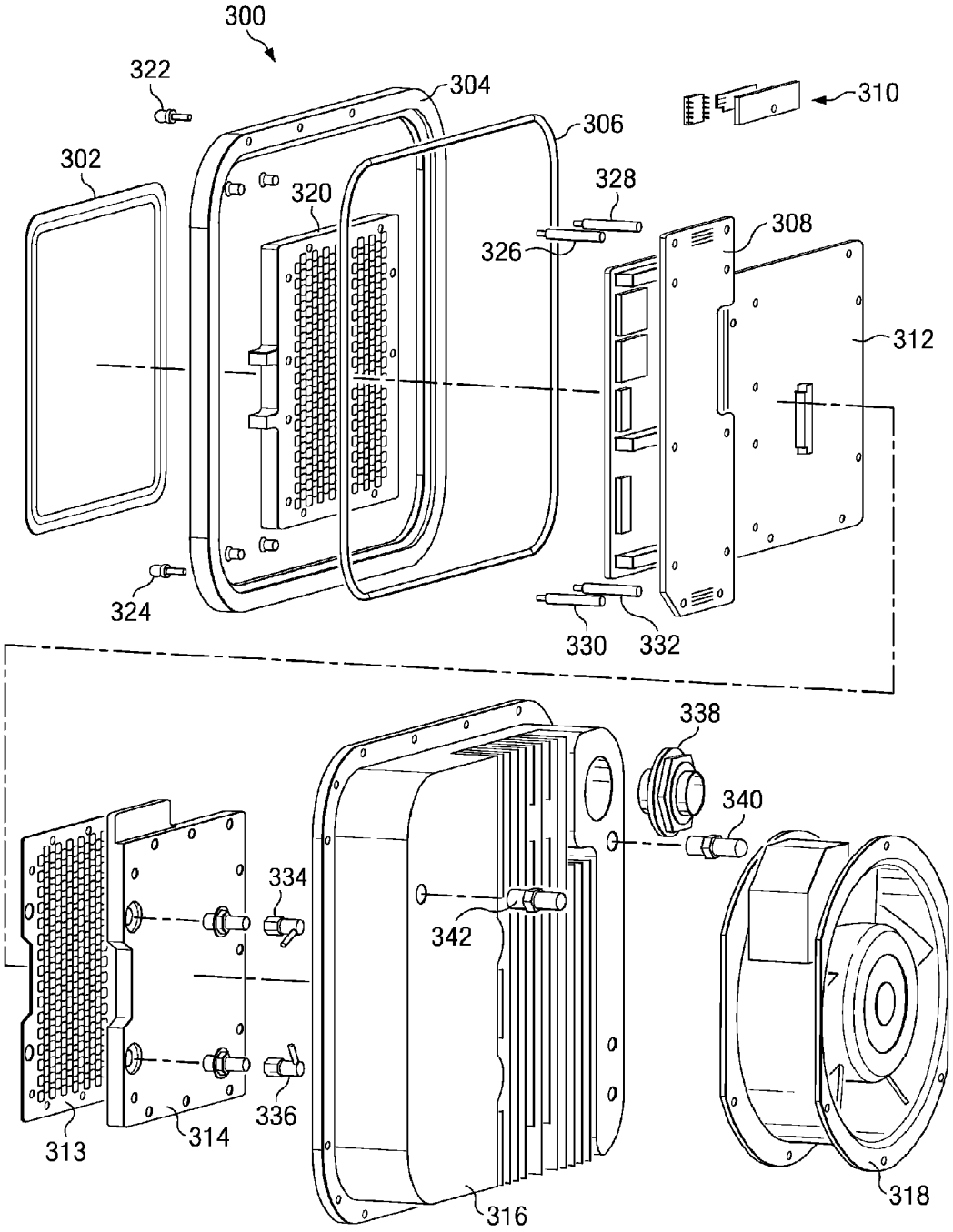
FIG. 3 is an illustration of an antenna in an exploded view in accordance with an advantageous embodiment.

With reference now to FIG. 3, an illustration of an antenna in an exploded view is depicted in accordance with an advantageous embodiment. In this example, antenna 300 is a dual-beam dual-selectable polarization array antenna. In this example, antenna 300 is a 256-element phased array antenna. Antenna 300 is an example of one implementation of the block diagram of antenna 200 in FIG. 2.

In this example, antenna 300 may operate in a K-band at or around 20 GHz. Antenna 300 may support a 60 degree scan at around 20 GHz. In this example, antenna 300 may generate two beams. The instantaneous bandwidth of antenna 300 may be around 500 MHz at a minimum. The type of scan coverage may be, for example, a 60 degree conical scan. This type of antenna may provide a dynamic range of at least 20 dB. The beam width may be around 7 degrees at boresight and around 13 degrees at a 60 degree scan. In these examples, boresight is a vector that is orthogonal to the plane of the aperture. Further, antenna 300 may provide a right-hand circular polarization and/or a left-hand circular polarization.

In this example, antenna 300 includes wide angle impedance matching stackup 302, Aperture plate 304, o-ring 306, controller 308, temperature sensor 310, printed wiring board assembly 312, seal ring 313, pressure plate 314, rear housing 316, and fan 318.

Wide angle impedance matching stackup 302 provides improved axial ratio as the array is scanned off boresight in addition to improving the impedance match that chips on printed wiring board assembly 312 see. The axial ratio is the ratio of major to minor axes of an elliptically polarized antenna beam. A one to one ratio may indicate a beam with a perfectly circular polarization.

Electromagnetic energy radiating out of aperture plate 304 may encounter a different wave impedance in the free space as the scan angle increases. Improving or increasing the impedance may reduce the loss of radiating energy at a larger scan angle. When a phased array is scanned off-boresight the axial ratio defined by the polarization ellipse degrades to something that is less than circular polarization. The wide angle impedance matching negates much of this affect. Further, wide angle impedance matching stackup 302 also may decrease mutual coupling between individual elements. In this example, an element is a combination of a single radiating element and a single chip unit.

Aperture plate 304 is an aperture unit in these examples and is an example of aperture unit 204 in FIG. 2. A signal received by aperture plate 304 may travel through waveguides 320. In these examples, waveguides 320 are circular waveguides. Waveguides 320 may also be referred to as honeycomb waveguides.

In these illustrative examples, each waveguide within waveguides 320 may be filled with a material, such as, for example, without limitation, a dielectric. For example, a polystyrene microwave plastic may be employed. In particular, Rexolite® may be placed within the circular waveguides within waveguides 320. Examples of other dielectrics include glass and ceramic materials. The signal may then travel to chips located on printed wiring board assembly 312.

The signal may pass through radiating elements that provide polarization diverse waveguide transition. A polarization diverse waveguide transition is, in this case, a radiating element that can receive signals from a chip unit to produce a number of different polarizations. These polarizations include, without limitation, left-handed circular polarization and right-handed circular polarization. Chips on printed wiring board assembly 312 may then process the signal to provide dual beam operation.

In other words, printed wiring board assembly 312 includes circuits that may be used to generate signals for two radio frequency beams that may have different polarizations. The signals may be combined off printed wiring board assembly 312 individually.

In these examples, housing bolts 322 and 324 are used to secure aperture plate 304 to rear housing 316. Standoffs 326, 328, 330, and 332 provide spacing between controller 308 when mounted to aperture plate 304. Radio frequency connectors 334 and 336 are used to transmit radio frequency signals that may be received or sent by antenna 300 to an exterior component. This exterior component may be, for example, a satellite communications (SATCOM) terminal.

Direct current connector 338 provides a connector to provide power in addition to serial control from the control unit 106 to controller 210 to antenna 300. Nitrogen pressurization valves 340 and 342 may provide a means of pressurizing antenna 300 with a gas, such as pressurized nitrogen, for environmental sealing. Fan 318 is an example of fan 216 in FIG. 2 and may provide further cooling to antenna 300.

Seal ring 313 is an example of seal ring 212 in FIG. 2. Seal ring 313 electrically isolates chip units 218 in their own cavities, which are created by the bounds of the printed wiring board, pressure plate, and seal ring.

Figure 4:
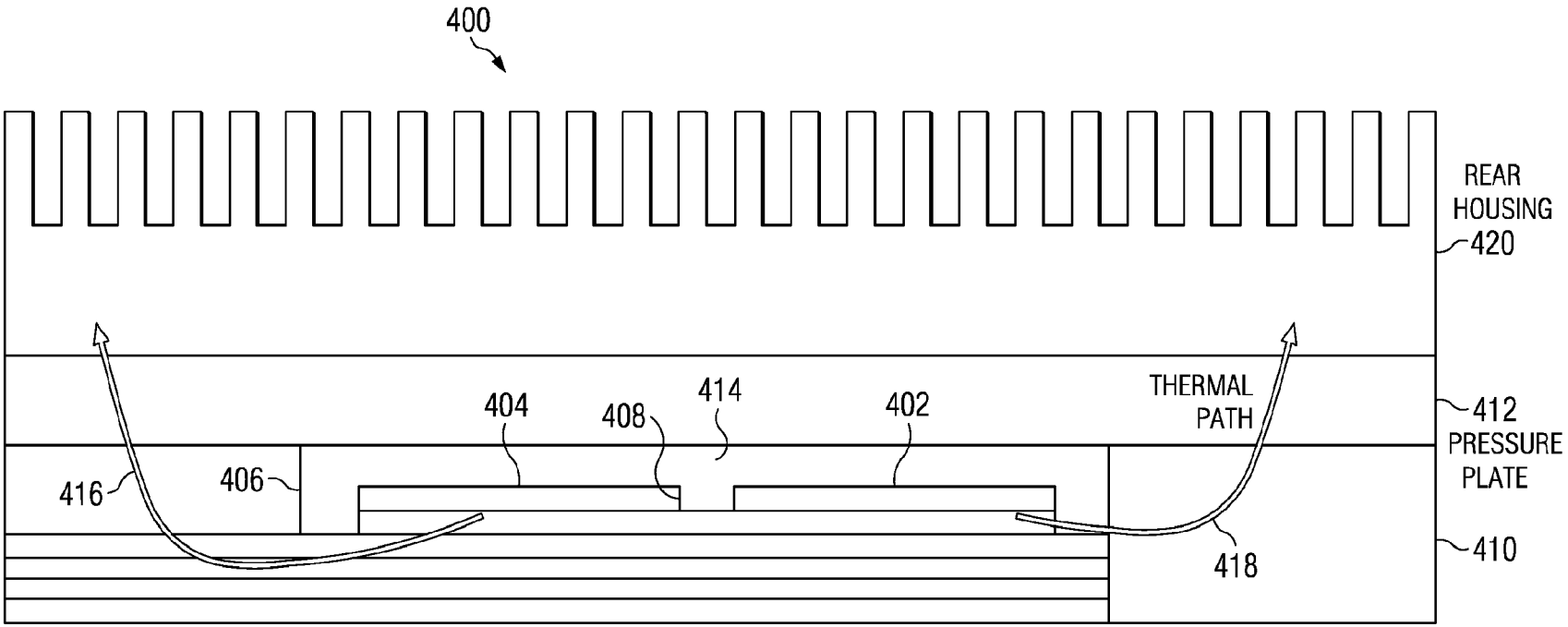
FIG. 4 is a diagram illustrating a cross-sectional view of a portion of an antenna in accordance with an advantageous embodiment.

With reference now to FIG. 4, a diagram illustrating a cross-sectional view of a portion of an antenna is depicted in accordance with an advantageous embodiment. In this example, printing wiring assembly 400 has chips 402 and 404 mounted on side 406. In these examples, printed wiring assembly 400 is an example of printed wiring assembly 208 in FIG. 2 and chips 402 and 404 are examples of chips that may be found in chip units 218 in FIG. 2.

In these examples, chips 402 and 404 are mounted onto printed wiring assembly 400 using molybdenum tab 408. Molybdenum tab 408 is a layer of material that is used to prevent cracking or dislodgement of chips 402 and 404 due to thermal expansion. This material may be, for example, a copper-molybdenum-copper stackup. In other words, molybdenum tab 408 is used to take into account that printed wiring board assembly 400 and chips 402 and 404 may have different rates of thermal expansion and contraction.

In this example, heat may travel from chips 402 and 404 into printed wiring assembly 400. From that point, heat may travel through seal ring 410 into pressure plate 412. These pathways are identified by arrows 416 and 418. These heat pathways provide cooling for chips 402 and 404.

Further, heat also may radiate directly to pressure plate 412 through space 414 created by seal ring 410. The heat may then travel from pressure plate 412 to rear-housing 420. In other advantageous embodiments, pressure plate 412 may be cooled through methods other than convection. For example, pressure plate 412 may include small pipes to carry coolant throughout pressure plate 412.

Figure 5:
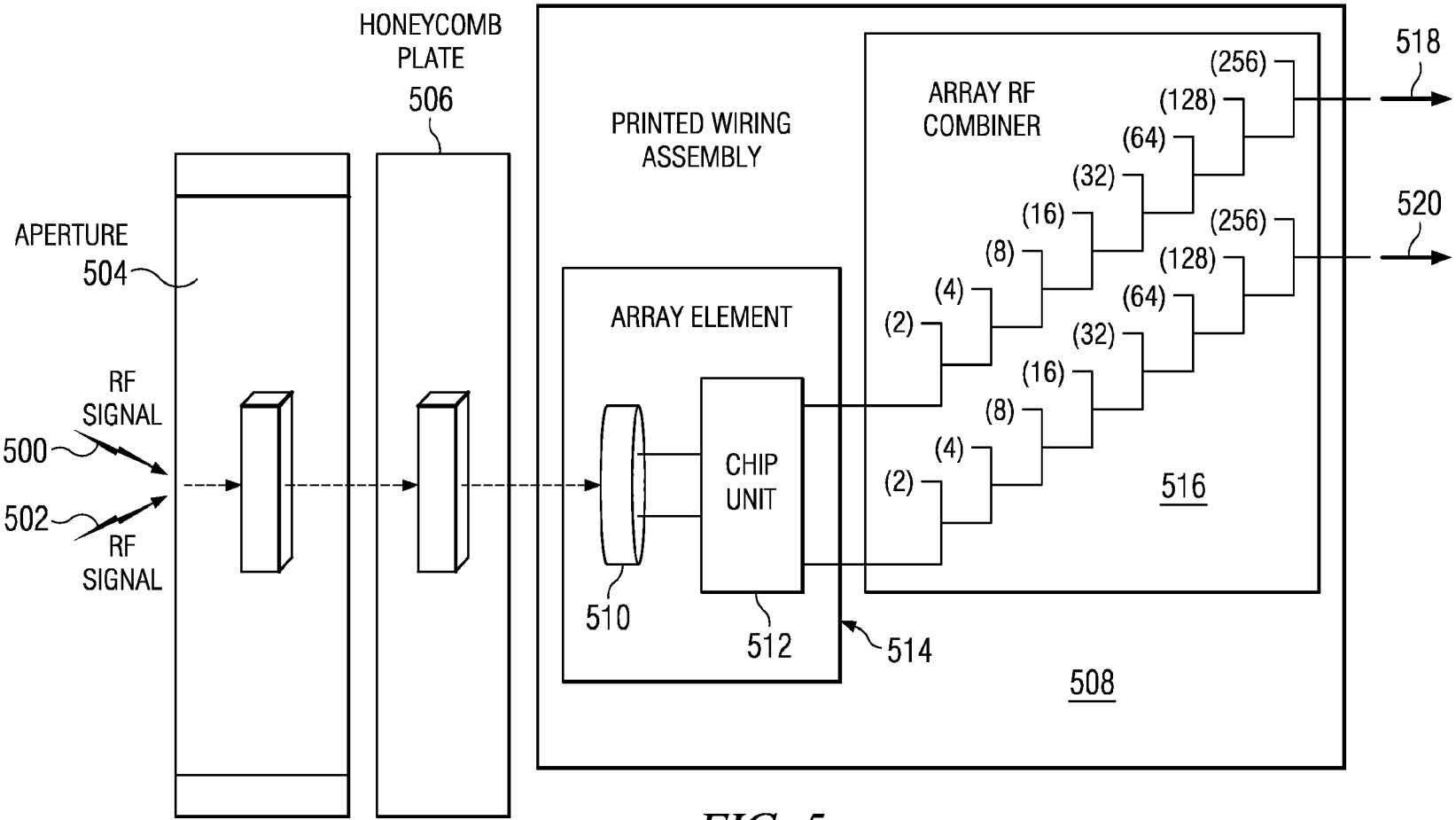
FIG. 5 is a diagram illustrating signal flow through an antenna in accordance with an advantageous embodiment.

With reference now to FIG. 5, a diagram illustrating signal flow through an antenna is depicted in accordance with an advantageous embodiment. This signal flow may be through an antenna, such as antenna 300 in FIG. 3. In this example, radio frequency signal 500 is located in one beam while radio frequency signal 502 is located in another beam. These signals are received by aperture 504 and passed through honeycomb plate 506 to reach printed wiring assembly 508.

Aperture 504 may include a wide angle impedance matching sheet used to provide for impedance matching. Honeycomb plate 506 may act as a wave guide for radio frequency energy. Honeycomb plate 506 may guide radio frequency energy to the different radiating elements within printed wiring assembly 508. These signals are detected and received by a radiating element, such as radiating element 510 in printed wiring assembly 508.

Radiating element 510 may provide a transition from waves of radio frequency energy to electrical signals running through traces within printed wiring assembly 508 that will be processed by chip unit 512. Radiating element 510 is an example of a radiating element within radiating elements 217 in FIG. 2.

The signals are then propagated to chip unit 512, mounted on or formed within printed wiring assembly 508, which may transform radio frequency signal 500 and radio frequency signal 502 into a pair of polarized signals. Chip unit 512 is a set of chips or integrated circuits. Chip unit 512 is an example of a chip unit within chip units 218 in FIG. 2. In these examples, radiating element 510 and chip unit 512 form array element 514.

The polarized signals may be right-hand circular polarized and/or left-hand circular polarized. Chip unit 512 allows for these signals to be switchable between the two types of polarization for each received radio frequency signal.

The output of chip unit 512 may then be sent to array radio frequency combiner network 516, which also is located within printed wiring assembly 508. Array radio frequency combiner network 516 takes the signal from each array element and combines them all into a single output for each beam. Array radio frequency combiner network 516 generates radio frequency signal output 518 and radio frequency signal output 520. At this point, these signals are sent to a component outside of the antenna for processing.

Figure 6:
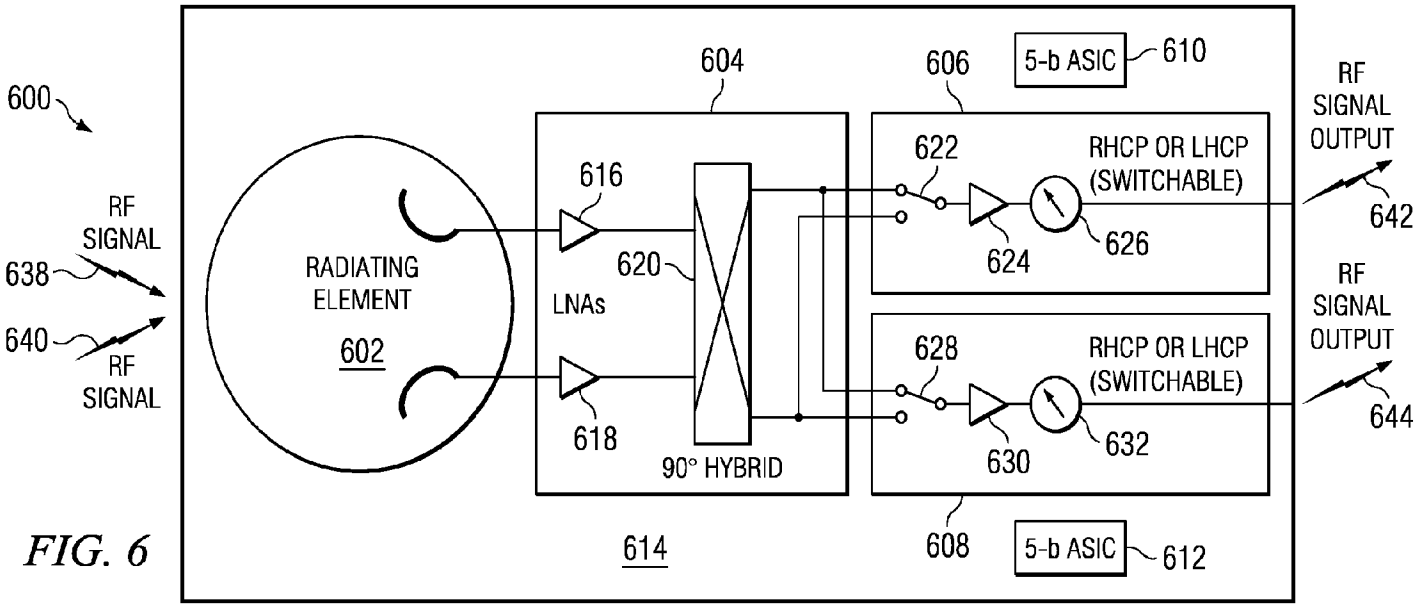
FIG. 6 is a diagram illustrating an array element in accordance with an advantageous embodiment.

With reference now to FIG. 6, a diagram illustrating an array element is depicted in accordance with an advantageous embodiment. In this example, array element 600 is an example of array element 514 in FIG. 5. In this example, array element 600 includes radiating element 602, low noise amplifier 604, phase shifter 606, phase shifter 608, application specific integrated circuit 610, and application specific integrated circuit 612. In these illustrative examples, low noise amplifier 604, phase shifter 606, phase shifter 608, application specific integrated circuit 610, and application specific integrated circuit 612 form a chip unit.

Radiating element 602 is embedded within printing wiring assembly 614. In these examples, radiating element 622 may be located on an opposite side of printing wiring assembly 614 from the other components illustrated for array element architecture 600. In this example, amplifier circuit 604 includes low noise amplifier 616 and low noise amplifier 618. Further, amplifier circuit 604 also includes hybrid coupler 620. This component combines two input signals received from two input ports with a +90 or −90 degree phase difference to each of the two output ports for right hand or left hand circular polarization.

In the depicted example, phase shifter 606 includes polarization switch 622, low noise amplifier 624, and phase shifter 626. Phase shifter 608 includes polarization switch 628, low noise amplifier 630, and phase shifter 632. In this example, phase sifter 626 and phase shifter 632 are four byte digital phase shifters. Of course, other types of phase shifters may be used depending on the particular implementation.

Phase shifter 606 may be controlled by control chip 610 for polarization switching and phase shifting. Phase shifter 608 may be controlled by control 612 for polarization switching and phase shifting in these examples.

Radio frequency signals 638 and 640 may be received by received array element 600. These signals may be detected or received by radiating element 602. One signal is sent to low noise amplifier 616, while the other signal is sent to low noise amplifier 618. These signals are sent to low noise amplifiers 616 and 618 based on their specific polarization configurations after these signals have been recombined by hybrid coupler 620. These signals may be directed to phase shifter 606 or 608 using polarization switches 622 and 628. In other words, radio frequency signal 638 may pass through phase shifter 606 or phase shifter 608 with radio frequency signal 640 passing through the one of other phase shifters.

In addition to selecting which beam becomes the output signal, phase shifters 626 and 632 may be able to change the polarization of radio frequency signal 638 and 640. The polarization may be right-hand circularly polarized or left-hand circularly polarized depending on the selection.

The switching and selection of polarization may be controlled using application specific integrated circuit 610 and application specific integrated circuit 612. The output from array element architecture 600 is radio frequency signal output 642 and radio frequency signal output 644.

Figure 7:
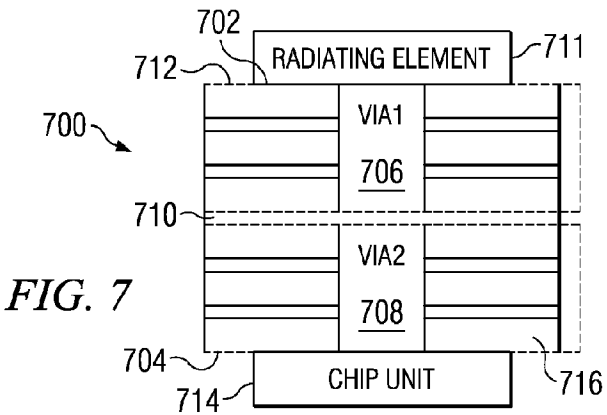
FIG. 7 is a diagram illustrating a partial cross-sectional view of a printed wiring assembly in accordance with an advantageous embodiment.

With reference now to FIG. 7, a diagram illustrating a partial cross-sectional view of a printed wiring board is depicted in accordance with an advantageous embodiment. In this example, printed wiring board 700 is an example of printed wiring board 215 in FIG. 2.

In this illustrative example, printed wiring board 700 includes sub-assembly 702 and sub-assembly 704. These sub-assemblies are examples of sub-assembly 220 in FIG. 2. Sub-assembly 702 and sub-assembly 704 are bonded to each other using bonding layer 710. Bonding layer 710 provides mechanical bonding as well as electrical properties to connect via 706 and via 708 to each other. In these examples, bonding layer 710 may be made from a bonding material, such as bonding material 222 in FIG. 2. In particular, ORMET® may be used for the electrically conductive areas of bonding layer 710.

Through this type of architecture, the diameters of via 706 and via 708 may be reduced as opposed to having a single via penetrate the entire printed wiring board 700 as used in conventional architectures. In this manner, the size of the designs and architectures on printed wiring board 700 may be reduced in size to fit more circuitry with respect to radiating elements. In other words, this type of architecture in printed wiring board 700 may allow more and/or smaller radiating elements to be placed on opposite sides of the associated chips providing the array element circuits.

For example, radiating element 711 may be formed on or within side 712 of printed wiring board 700. Chip unit 714 may be formed or mounted on side 716 of printed wiring board 700. Radiating element 711 and chip unit 714 may be electrically connected to each other through via 706, bonding layer 710, and via 708. In this manner, a radiating element may be located opposite of a corresponding chip unit in a manner that does not require a 90 degree angle or bend in the electrical path connecting these two elements.

Figure 8:
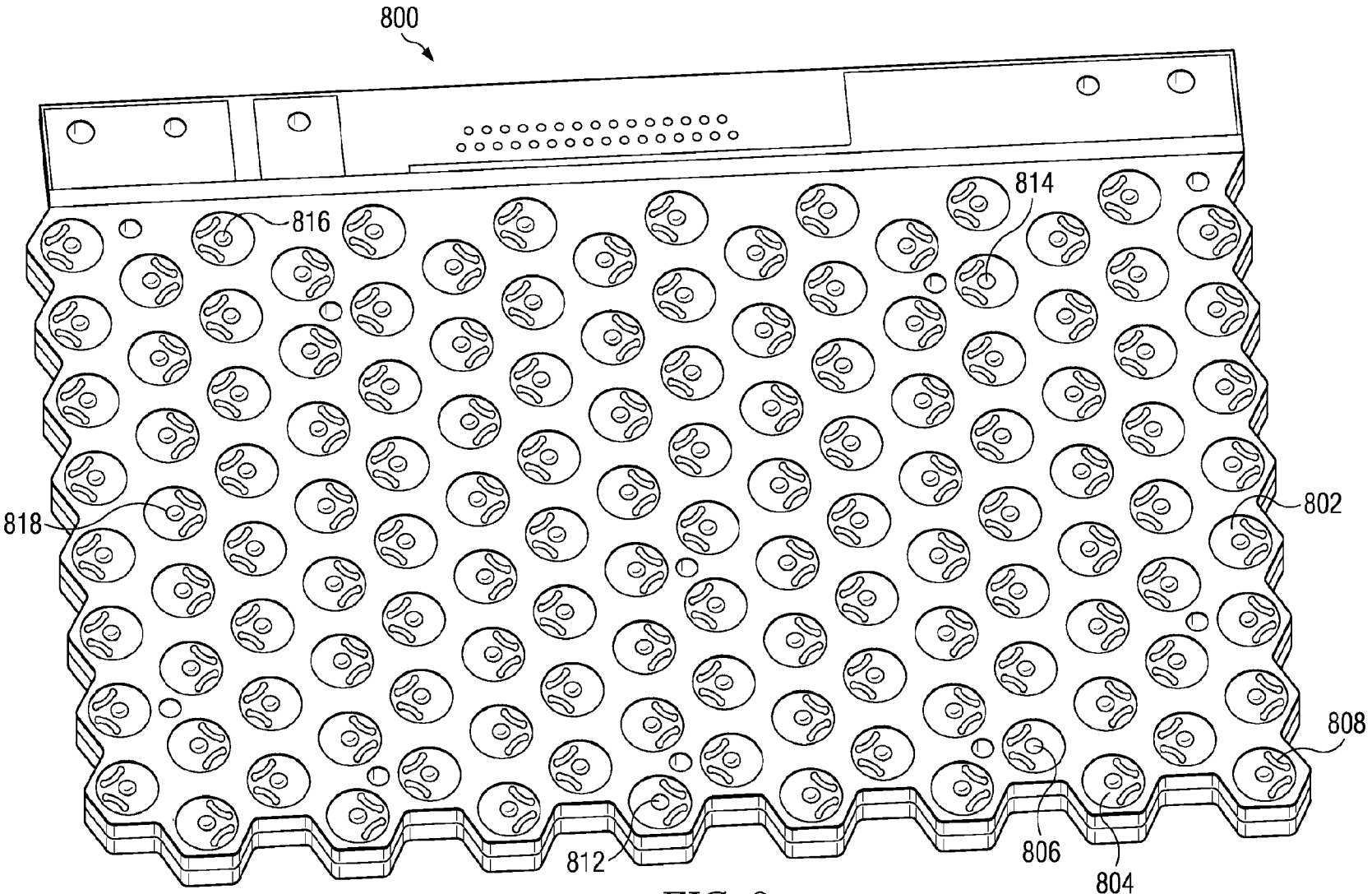
FIG. 8 is a diagram of a printed wiring board assembly in accordance with an advantageous embodiment.

With reference now to FIG. 8, a diagram of a printed wiring board is depicted in accordance with an advantageous embodiment. In this example, printing wiring board 800 is an example of one implementation for printed wiring board 215 in FIG. 2. As can be seen in this example, printed wiring board 800 includes array 802 containing radiating elements. Elements 804, 806, 808, 812, 814, 816, and 818 are examples of radiating elements within array 802. In this illustrative example, array 802 includes 128 radiating elements.

Of course, in other embodiments other numbers of radiating elements may be used. For example, a printed wiring assembly may have 64 or 256 radiating elements. The illustration of these radiating elements is not meant to limit the number or manner in which radiating elements in array 802 may be selected or arranged for printed wiring assembly 800.

Figure 9:
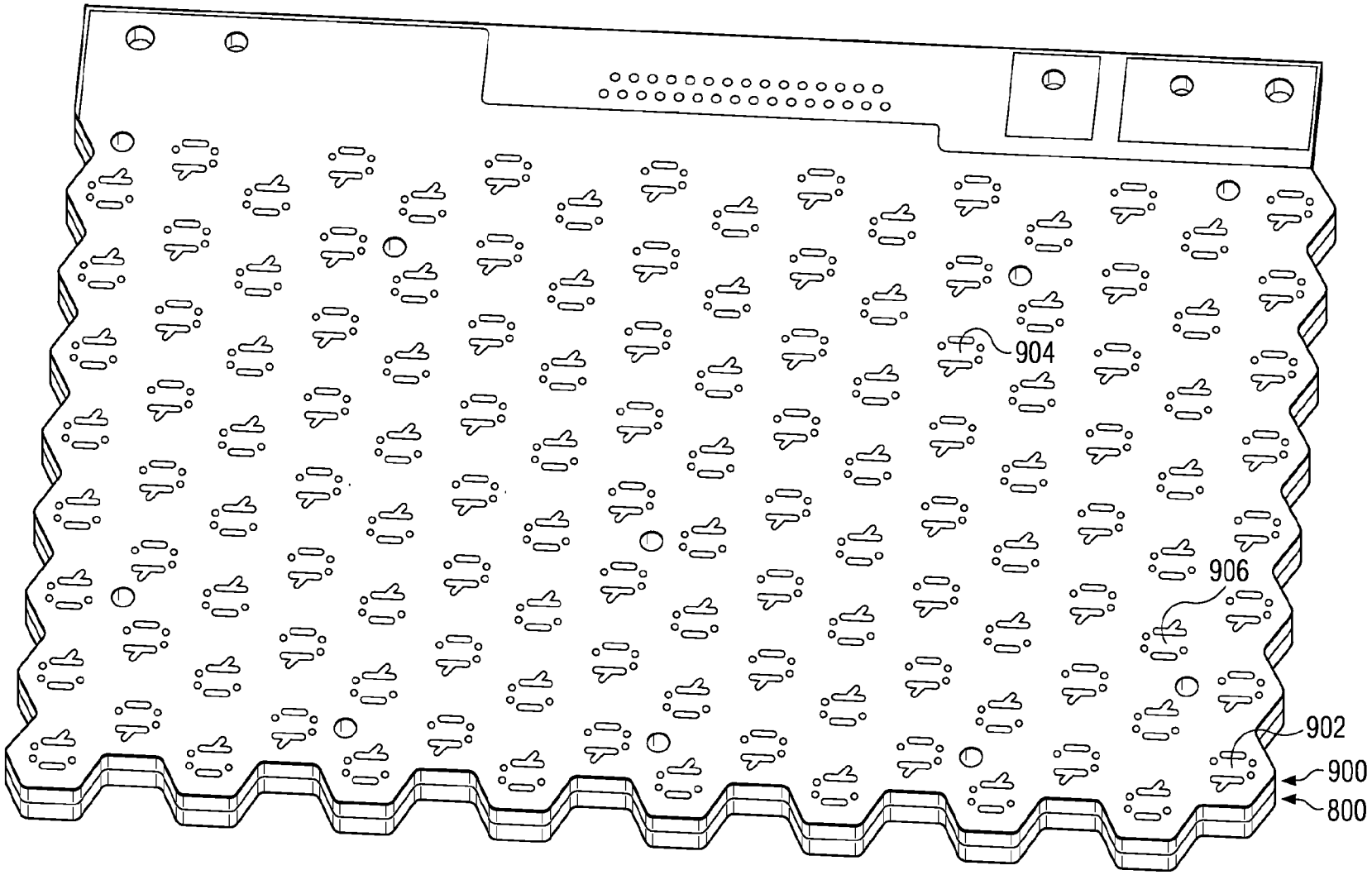
FIG. 9 is a diagram of a printed wiring assembly in accordance with an advantageous embodiment.

With reference now to FIG. 9, a diagram of a printed wiring board is depicted in accordance with an advantageous embodiment. In this example, backside 900 of printed wiring board 800 in FIG. 8 is illustrated. Backside 900 provides a location for which chips may be attached to printed wiring board 800 in FIG. 8. For example, chips may be placed on locations such as points 902, 906, and 904. These points have a corresponding radiating element on the other side of printed wiring board 800 in FIG. 8. In this manner, 90 degree bends in the connections between the chips and radiating elements may be avoided.

Figure 10:
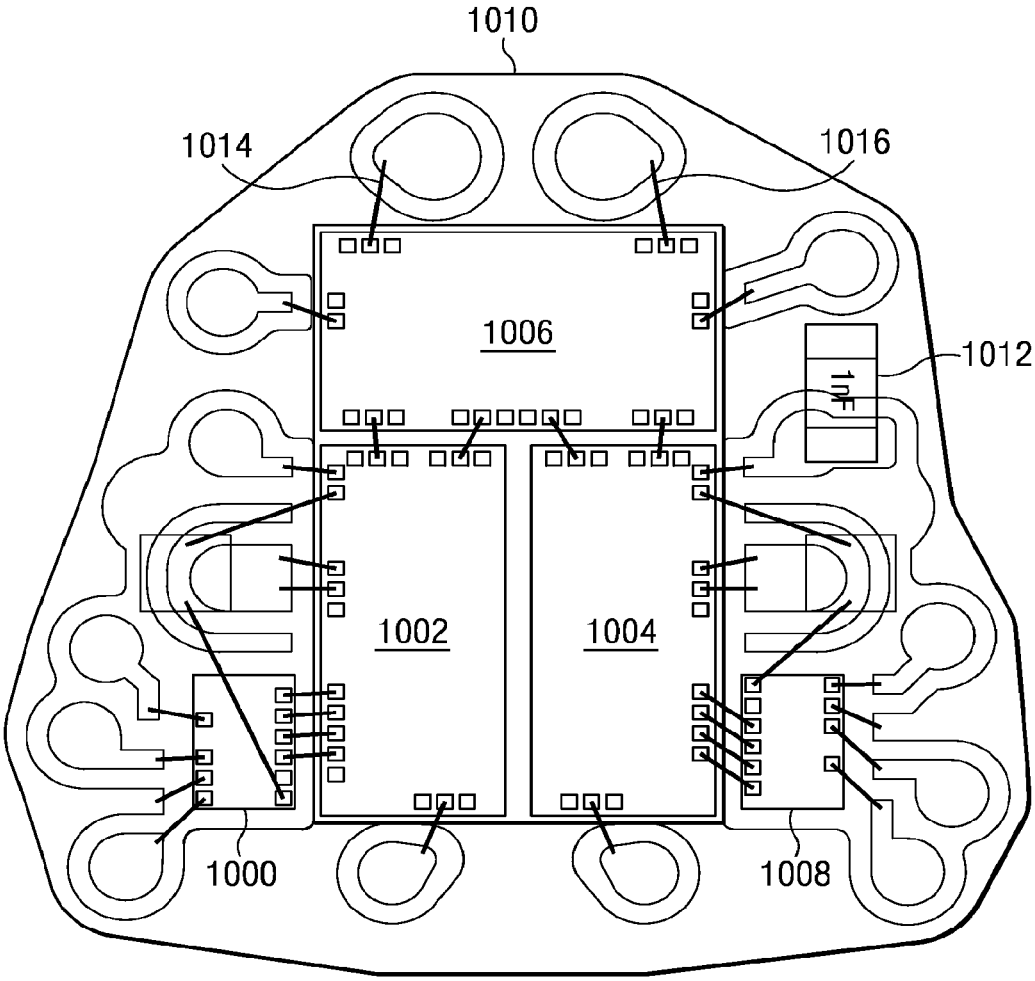
FIG. 10 is a diagram illustrating chips mounted on a printed wiring assembly in accordance with an advantageous embodiment.

With reference now to FIG. 10, a diagram illustrating a wire bonding layout for chips mounted on a printed wiring board is depicted in accordance with an advantageous embodiment. In this example, chips 1000, 1002, 1004, 1006, and 1008 represent chips that may be mounted on printed wiring assembly 1010. Chip 1006 is an amplifier, while chips 1002 and 1004 provide phase-shifting and polarization selection of the selected signal. Chips 1000 and 1008 are application specific integrated circuits (ASIC) in these examples.

Chip capacitor 1012 may be used as a decoupling capacitor to remove noise from a direct current by a direct current bias line. This capacitor may have a value of around 1 nanofarad. Amplifier chip 1006 may be connected to the corresponding radiating element on the other side of printed wiring assembly 1010 using the wire bond connections 1014 and 1016. These wire bond connections connect the vias that lead to the radiating element on the other side of printed wiring assembly 1010.

Thus, the different advantageous embodiments provide a dual beam dual selectable polarization phased array antenna. This antenna may generate two beams in which the polarization for each beam may be selectable independently of the other beam. The antenna includes an aperture unit, a multilayer printed wiring board assembly, radio frequency radiating elements, chip units, a pressure plate, and a housing.

The multi-layer printed wiring board, in these examples, has a plurality of subassemblies that are bonded to each other with a bonding material that provides both a mechanical and an electrical connection. The radio frequency radiating elements are formed in the printed wiring board.

The chip units may be mounted on the multi-layer printed wiring board in which the chip units include circuits capable of controlling radio frequency signals radiated by the radio frequency radiating elements to form dual beams with selectable polarization. The multi-layer printed wiring assembly is mounted on the pressure plate. These components are placed in the rear housing with the aperture unit forming a cover or top portion of the housing.

This architecture and design for the antenna takes the form of a tile architecture with reduced space requirements due to the different features of the advantageous embodiments. In this manner, one or more of the different features may provide for spacing savings over other antenna designs.

The description of the different advantageous embodiments has been presented for purposes of illustration and description, and is not intended to be exhaustive or limited to the embodiments in the form disclosed. Many modifications and variations will be apparent to those of ordinary skill in the art.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An antenna assembly comprising:

an aperture unit;

a multilayer printed wiring board having a plurality of sub assemblies bonded to each other with a bonding material providing both mechanical and electrical connection, wherein the multilayer printed wiring board is connected to the aperture unit;

a plurality of radio frequency radiating elements formed on the multilayer printed wiring board; and a plurality of chip units mounted on the multilayer printed wiring board, wherein the plurality of radio frequency radiating elements are located on one side of the multilayer printed wiring board and the plurality of chip units are located on an opposite side of the multilayer printed wiring board, each radio frequency radiating element in the plurality of radio frequency radiating elements connected to a chip unit in the plurality of chip units, the radio frequency radiating element bonded to the chip unit with the bonding material such that a first via in the radiating element electrically connects with a second via in the chip unit, the bonding material positioned between the first via and the second via, wherein the plurality of chip units includes circuits configured to control radio frequency signals radiated by the plurality of radio frequency radiating elements to form dual beams with selectable polarization.

2. The antenna assembly of claim 1, further comprising a controller connected to the multilayer printed wiring assembly, the controller configured to send signals to the plurality of chip units to control the radio frequency signals.

3. The antenna assembly of claim 1 further comprising a pressure plate connected to the aperture unit.

4. The antenna assembly of claim 3 further comprising a seal ring located between the pressure plate and the multilayer printed wiring board.

5. The antenna assembly of claim 1 further comprising a housing unit, wherein the aperture unit is connected to the housing unit.

6. The antenna assembly of claim 5 further comprising pressurized nitrogen located within the housing unit.

7. The antenna assembly of claim 1, wherein the aperture unit further comprises a honeycomb aperture plate.

8. An antenna assembly comprising:

an aperture unit;

a multilayer printed wiring board having a plurality of sub assemblies bonded to each other with a bonding material providing both mechanical and electrical connection, wherein the multilayer printed wiring board is connected to the aperture unit;

a plurality of radio frequency radiating elements formed on the multilayer printed wiring board; and a plurality of chip units, wherein the plurality of chip units is mounted on the multilayer printed wiring board, wherein the plurality of chip units includes circuits configured to control radio frequency signals radiated by the plurality of radio frequency radiating elements to form dual beams with selectable polarization, and wherein the plurality of radio frequency radiating elements are located on one side of the multilayer printed wiring board and the plurality of chip units are located on an opposite side of the multilayer printed wiring board, each radio frequency radiating element in the plurality of radio frequency radiating elements connected to a chip unit in the plurality of chip units, the radio frequency radiating element bonded to the chip unit with the bonding material such that a first via in the radiating element electrically connects with a second via in the chip unit, the bonding material positioned between the first via and the second via.

9. The antenna assembly of claim 8 further comprising a pressure plate connected to the aperture unit and a seal ring located between the pressure plate and the multilayer printed wiring board, wherein the plurality of radio frequency radiating elements are located on a first side of the multilayer printed wiring board and the plurality of chip units are located on an opposite side of the multilayer printed wiring board in an area defined by the seal ring.

10. The antenna assembly of claim 9, wherein heat from the plurality of chip units flows in a path through the printed wiring assembly, the seal ring, and the pressure plate.

11. The antenna assembly of claim 8 further comprising a pressure plate and a temperature sensor connected to the pressure plate, wherein the temperature sensor is capable detecting a temperature of the pressure plate, the pressure plate connected to the aperture unit.

12. An apparatus comprising:

a printed wiring board having a plurality of sub assemblies bonded to each other with a bonding material providing both mechanical and electrical connection;

a plurality of radio frequency radiating elements located on the printed wiring board; and a plurality of chip units located on the printed wiring board, wherein the plurality of chip units are configured to control radio frequency signals radiated by the plurality of radio frequency radiating elements to form dual beams with selectable polarization, wherein the plurality of radio frequency radiating elements are located on one side of the multilayer printed wiring board and the plurality of chip units are located on an opposite side of the multilayer printed wiring board, each radio frequency radiating element in the plurality of radio frequency radiating elements connected to a chip unit in the plurality of chip units, the radio frequency radiating element bonded to the chip unit with the bonding material such that a first via in the radiating element electrically connects with a second via in the chip unit, the bonding material positioned between the first via and the second via.

13. The apparatus of claim 12 further comprising a housing unit, wherein the printed wiring board, the plurality of radio frequency radiating elements, and the plurality of chip units are located inside the housing unit.

14. The apparatus of claim 13, wherein the housing unit comprises an aperture unit and a rear housing.

15. The apparatus of claim 12 further comprising a controller connected to the multilayer printed wiring board and capable of sending signals to the plurality of chip units to control the radio frequency signals.

* * * * *